US007774950B2

(12) United States Patent
Lasley

(10) Patent No.: US 7,774,950 B2
(45) Date of Patent: Aug. 17, 2010

(54) LEVELING DEVICE

(76) Inventor: Matthew W. Lasley, 3450 Lick Creek Rd., Anna, IL (US) 62906

( * ) Notice: Subject to any disclaimer, the term of this patent is extended or adjusted under 35 U.S.C. 154(b) by 57 days.

(21) Appl. No.: 12/245,465

(22) Filed: Oct. 3, 2008

(65) Prior Publication Data

US 2010/0084523 A1 Apr. 8, 2010

(51) Int. Cl.
*G01B 21/30* (2006.01)
*G01B 5/20* (2006.01)

(52) U.S. Cl. ..... 33/533; 33/561.1; 33/514.2

(58) Field of Classification Search ..... 33/514.2, 33/515, 521, 533, 561.1, 561.2, 561.3
See application file for complete search history.

(56) References Cited

U.S. PATENT DOCUMENTS

| | | | | | |
|---|---|---|---|---|---|
| 2,163,938 | A * | 6/1939 | Dickson | 33/561.1 |
| 2,378,039 | A * | 6/1945 | Schenker | 33/514.2 |
| 2,615,255 | A * | 10/1952 | Rankin | 33/561.1 |
| 2,621,415 | A * | 12/1952 | Cooper | 33/561.1 |
| 2,913,207 | A | 11/1959 | Neash | |
| 4,032,099 | A | 6/1977 | Maude | |
| 4,265,024 | A * | 5/1981 | Handte | 33/561.1 |
| 4,353,171 | A * | 10/1982 | Spears | 33/521 |
| 4,936,560 | A * | 6/1990 | Barozzi | 33/561.1 |
| 4,956,924 | A * | 9/1990 | Hu | 33/561.1 |
| 5,364,163 | A | 11/1994 | Hardison | |
| 5,383,282 | A * | 1/1995 | Field et al. | 33/561.1 |
| 5,494,333 | A | 2/1996 | Wilson | |
| 5,640,779 | A * | 6/1997 | Rolloff et al. | 33/514.2 |
| 6,036,148 | A | 3/2000 | Shank | |
| 6,160,264 | A * | 12/2000 | Rebiere | 33/514.2 |
| 6,209,215 | B1 * | 4/2001 | Helms | 33/561.2 |
| 6,213,436 | B1 | 4/2001 | Hembree | |
| 6,702,066 | B1 | 3/2004 | Eaton | |
| 6,871,911 | B2 | 3/2005 | Alexander, Jr. | |
| 6,905,172 | B1 | 6/2005 | Barnett | |
| 6,935,644 | B1 | 8/2005 | Oranday | |
| 7,346,998 | B2 * | 3/2008 | Tadin et al. | 33/515 |
| 2006/0225297 | A1 * | 10/2006 | Tadin et al. | 33/515 |
| 2008/0185898 | A1 * | 8/2008 | Ward et al. | 297/440.24 |

* cited by examiner

*Primary Examiner*—G. Bradley Bennett
(74) *Attorney, Agent, or Firm*—Levenfeld Pearlstein, LLC

(57) ABSTRACT

A leveling device comprises a generally horizontal frame configured to hold a number of parallel, closely spaced support legs in a generally vertical configuration. The support legs are slidably mounted in collars formed in the frame such that the legs may slide up and down within the collars. The support legs are configured to move independently of one another and to be locked into place using a locking mechanism configured to frictionally or mechanically engage the support legs once the legs are positioned to match the contour of the ground or other uneven surface. Multiple embodiments of the locking mechanism are disclosed. The leveling device of the present invention not only may be used to level an object on an uneven surface, but also can be used to adjust the height of an object on a even or uneven surface by adjusting the length of the support legs.

17 Claims, 6 Drawing Sheets

FIG.1
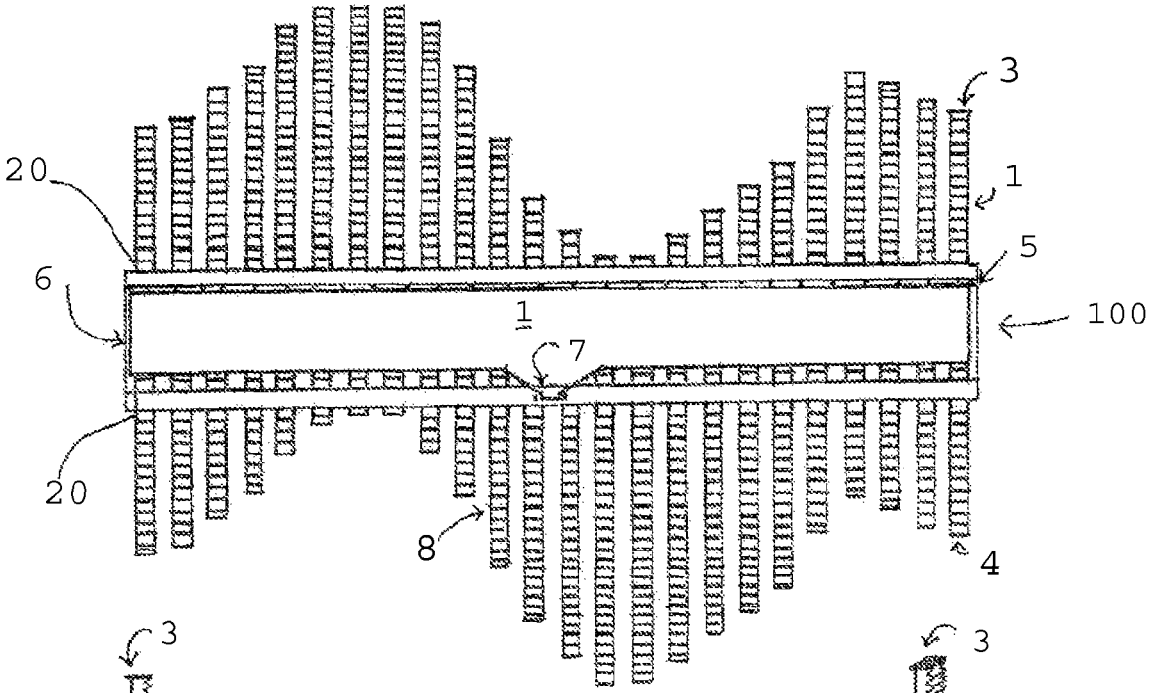
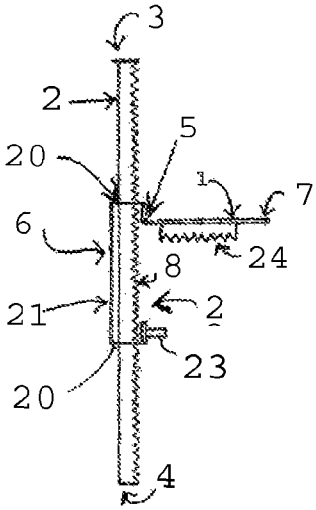
FIG. 2
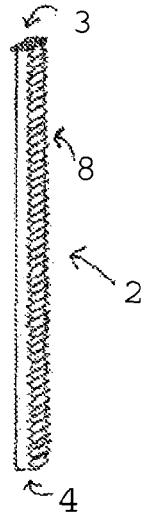
FIG. 3

FIG. 6
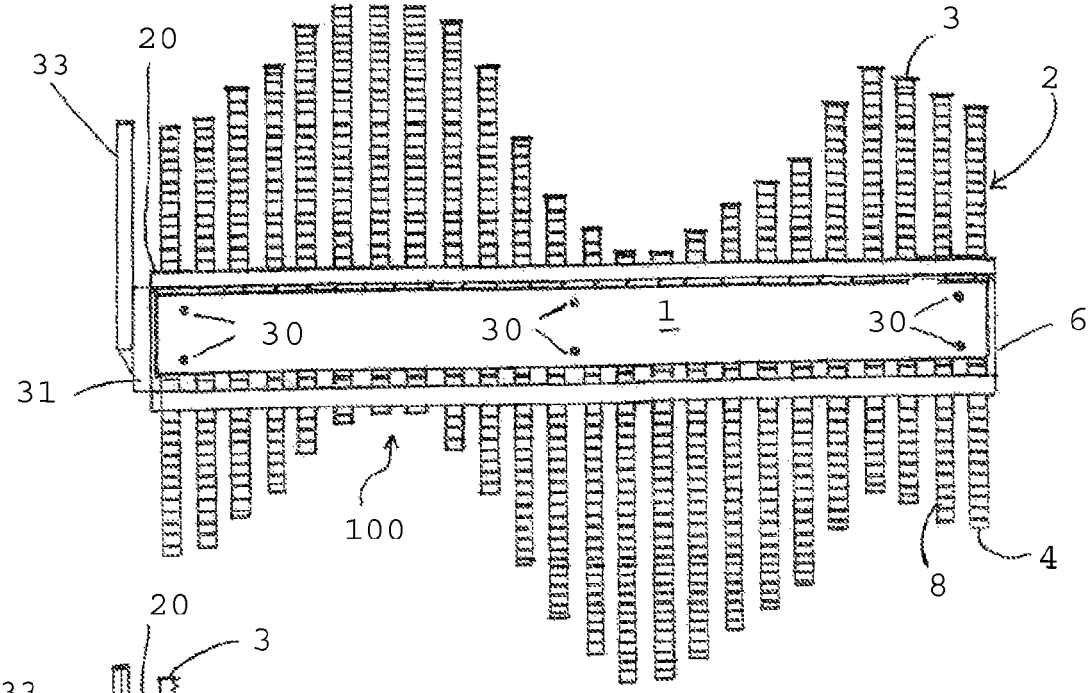
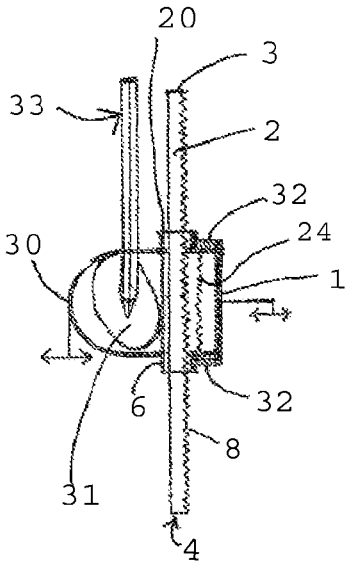
FIG. 7

LEVELING DEVICE

BACKGROUND OF THE INVENTION

The present invention concerns a leveling device that is configured to be integrated with, or attached to, an object, such as a chair, bucket, table, jack or other object, in order to keep the object level when placed on an uneven or a non-level surface.

Many objects require an even, level underlying surface for optimal use. For example, objects such as chairs, buckets, tables, ladders, scaffolding, jacks, barbeque grills and portable stairs are designed with the assumption that the object will be placed on an even, level underlying surface. However, when such objects are used outdoors, rarely is such an underlying surface available. Thus, using such products outdoors oftentimes involves the challenging and frustrating search for a suitable area of land.

As but one example, participants and spectators of various outdoor activities, such as sporting events, fireworks displays, fishing derbies, parades, etc. typically use traditional folding lawn chairs for seating during such activities. Traditional folding lawn chairs typically include a three piece frame comprised of an integral hinged seating platform and back support, along with two foldable leg assemblies. The leg assemblies generally include front and rear horizontal support bars made of tubular aluminum and configured to engage the ground in order to support the chair in a stable manner.

Such folding lawn chairs commonly are placed on soft, grassy areas that may or may not be flat. Hard rocky and gravelly surfaces typically are avoided because such surfaces interact poorly with the rigid metal support bars of the chair, leading to unintended rocking and wobbling of the chair, and a general feeling of instability and discomfort by the user of the chair.

Additionally, uneven and sloping terrains often times are avoided because the design of such chairs assumes that the chairs will be used on level surfaces and does not provide a means for adjusting the pitch of the chair seating platform to account for such terrains.

That is, the seating platform of most traditional folding lawn chairs remains roughly parallel relative to the ground only when the ground is generally flat and level. As the slope of the ground changes, the angle of the seating platform relative to the vertical and horizontal axes of the ground changes, either decreasing or increasing.

When the angle of the seating platform decreases relative to the horizontal axis of the ground, the user of the chair fights the force of being pushed forward and out of the chair. When the angle of the seating platform increases relative to the horizontal axis of the ground, the user of the chair is forced backwards into the chair, sometimes uncomfortably so. On particularly steep slopes, there is the possibility that the chair could slide or topple.

Similarly, when the angle of the seating platform decreases relative to the vertical axis of the ground, the user of the chair fights the force of being pushed to left. When the angle of the seating platform increases relative to the vertical axis of the ground, the user of the chair fights the force of being pushed to the right.

At some point of frustration and/or discomfort, users may elect to sit directly on the ground, even though it may negatively affect the user's view of the activities being viewed or soil the user's clothing, in the case of dirty, muddy or wet ground.

The prior art has made numerous attempts to solve this problem. However, each of these attempts has shortcomings, which prevent them from fully achieving a practical solution to the problem, especially a solution that can be used across many types of objects, not just chairs.

For example, Alexander, Jr., U.S. Pat. No. 6,871,911, discloses a folding chair having a pair of adjustable, telescoping rear legs. The legs can be extended or retracted to allow the chair to sit on both level and sloping ground. A clamping device holds the retractable legs in place. However, the Alexander, Jr. device is not designed to be used on highly uneven surfaces, and its limited number of ground contact points may adversely affect its stability.

Wilson, U.S. Pat. No. 5,494,333, teaches a lawn chair, again configured to be used on sloping terrain. The chair includes three adjustable, telescoping legs that can be extended or retracted and locked into the desired position. Additionally, each leg includes a leveling foot that conforms to the slope of the terrain. However, like the Alexander, Jr. device, the Wilson chair is not designed to be used on highly uneven surfaces and the limited number of ground contact points does not maximize the chair's stability on particularly uneven surfaces.

Barnett, U.S. Pat. No. 6,905,172, discloses a chair having multiple, adjustable legs, each leg having a footer attached to the leg using a ball-and-socket-type connection. The legs may be extended or retracted and the footer may be adjusted to match the slope of the surface. However, like the previous adjustable chair patents, the number of ground contact points is small and, thus, the stability of the chair is not maximized.

In yet another example of the prior art, Shank, U.S. Pat. No. 6,036,148, teaches a folding lawn chair having independently adjustable mechanisms attached to each leg of the lawn chair that allow the lawn chair to be used on uneven ground. A clamping mechanism secures the telescoping mechanisms, which essentially comprise telescoping legs, to the regular tubular frame members of the chair. However, like the inventions disclosed in the previously discussed prior art patents, the chair in Shank is not designed to be used on highly uneven surfaces because it does not maximize the ground contact points.

U.S. Pat. No. 5,364,163 to Hardison discloses a fishing chair with adjustable legs. The legs are vertically adjustable and include spikes for engaging the ground. The legs are locked into place using spring-biased pins that engage holes formed in the legs. Because the device taught by the Hardison patent uses the same type of horizontal support bar that is found in traditional prior art folding chairs, it does not solve the problem of using such chairs on highly irregular surfaces.

As noted above, while chairs comprise one of the most commonly used outdoor devices for which a level surface provides for optimal use, there are a host of other devices for which an even, level underlying surface is preferred. Such devices include, for example, buckets, tables, ladders, scaffolding, jacks, barbeque grills and portable stairs. The prior art has developed various means in an attempt to provide such devices with the ability to be used on uneven surfaces.

For example, a number of devices have been developed to keep such objects level. U.S. Pat. No. 6,213,436 to Hembree, U.S. Pat. No. 6,935,644 to Oranday, and U.S. Pat. No. 2,913,207 to Eash each disclose a platform or container for holding another object (a bucket, a cooler, a camping grill, etc.). Each patent discloses a structure with vertically adjustable legs that may be extended and locked into place to level the platform/container with respect to a sloped surface. However, much like the prior art developed with respect to foldable lawn chairs (as discussed above) none of the inventions disclosed in these patents provide maximum stability on uneven surfaces, because the number of ground contact points is not maximized.

Lastly, U.S. Pat. No. 6,702,066 to Eaton teaches a ladder having slidable extensions fitted to the legs of the ladder and secured with bolts and wing nuts. The length of the legs may be independently adjusted. While the ladder is configured to be used on uneven surfaces, the adjustment means does not permit the ladder to be used on highly uneven surface. Moreover, the limited number of ground contact points does not maximize stability.

Therefore, a need exists for a leveling device that can be attached to or integrated with a wide variety of objects that are used outdoors and that are designed to be optimally used on level surfaces, such as a chairs, buckets, tables, jacks or other objects, in order to keep such objects level when placed on an uneven or a non-level surface. Preferably, such a leveling device can be used with a wide variety of objects. More preferably, such a leveling device can additionally act as a height adjustment mechanism to adjust the height of the objects. More preferably still, such a leveling device has numerous ground contact points to provide maximum stability. Most preferably, each individual ground contact point is independently adjustable so as to provide a near infinite level of adjustability and to customize the ground contact points to the contour of the ground.

BRIEF SUMMARY OF THE INVENTION

The leveling device of the present invention comprises a generally horizontal frame configured to hold a number of parallel, closely spaced support legs in a generally vertical configuration. The support legs are slidably mounted in collars formed in the frame such that the legs may slide up and down within the collars. The support legs are configured to move independently of one another and to be locked into place using a locking mechanism.

The support legs can be cylindrical or rectangular members, and are formed of lightweight and durable materials so that the leveling device is easily transportable and so that the legs are strong enough to support the load of the device. Accordingly, in some embodiments, such as when the leveling device is used, for example, with a jack intended to support a large amount of weight, the support legs can be made of steel or other high strength material.

The support legs preferably are formed with caps (or other stopping means) to prevent the support legs from passing completely through the frame. The bottom ends of the support legs (the portion of the support legs that engages the ground) may be formed flat or may be formed in a pointed geometry to engage the ground and provide additional traction and stability. This is especially useful if the leveling device will be used on a soft surface, such as grass.

The frame further comprises a locking mechanism configured to frictionally or mechanically engage the support legs once the legs are positioned against the ground or other uneven surface. Multiple embodiments of the locking mechanism are disclosed, and the precise configuration of the locking mechanism may vary slightly depending on the object being supported by the leveling device.

In each embodiment of the leveling device of the present invention, the locking mechanism is configured to lock all of the support legs simultaneously and independently of one another to form a mounting base that is customized to the contour of the ground or other support surface. Preferably, this is accomplished by frictionally engaging the support legs within the collars once the support legs have been properly positioned for a particular surface.

In one embodiment of the locking mechanism, engagement of the support legs within the collars is accomplished with a pressure plate. In this embodiment, the engaging surface of the pressure plate may be formed with grooves and/or protuberances (square, triangular, etc.), and the support legs may be formed with mating grooves and/or protuberances configured to matingly engage the pressure plate when the plate engages the support legs. The engagement of the grooves and/or protuberances further strengthens the frictional engagement of the support legs and the pressure plate and keeps the support legs from moving within the collars.

In one embodiment of the locking mechanism, the pressure plate is hingedly connected to the frame. The hinge may be located at the top of the pressure plate or the bottom of the pressure plate. The hinged pressure plate includes an arm to provide leverage when locking the support legs in place. A latch engagable with the arm holds the pressure plate in place once the support legs have been locked in place. A bolt may be used to secure the latch if the support legs will be locked into position for a long duration.

In another embodiment of the locking mechanism, the pressure plate is not hingedly connected to the frame, but rather is bolted to the frame using U-bolts such that the distance between the pressure plate and a pulling plate formed by the U-bolts can be varied. The distance between the pressure plate and the pulling plate is controlled using a cam mechanism.

When the distance between the pressure plate and the pulling plate is small, the pressure plate does not engage the support legs and the support legs may be vertically adjusted within the collars. When the support legs are ready to be locked into place, an arm connected to the cam mechanism is rotated, thereby increasing the distance between the pressure plate and the pulling plate and forcing the pressure plate to engage the support legs, thereby locking the support legs in place. As in the previous embodiment, the arm may be locked into place to maintain the support legs in a locked position.

In other embodiments of locking mechanism, particularly useful when the leveling device will be used with non-linear objects (such as a circular bucket), the leveling device and the pressure plate may be circular. In this embodiment, the locking mechanism comprises a chain binder-like device to force the pressure plate to engage the support legs, thereby locking the support legs in place.

It will be appreciated by those skilled in the art that the leveling device of the present invention not only may be used to level an object on an uneven surface, but also can be used to adjust the height of an object on a even or uneven surface by adjusting the length of the support legs.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein:

FIG. 1 is a front view of the leveling device embodying the principles of the present invention;

FIG. 2 is a cross-sectional side view of the leveling device embodying the principles of the present invention;

FIG. 3 is a perspective view of a support leg embodying the principles of the present invention;

FIG. 6 is a front view of an alternate embodiment of the leveling device embodying the principles of the present invention;

FIG. 7 is a cross-sectional side view of the alternate embodiment of the leveling device shown in FIG. 6;

DETAILED DESCRIPTION OF THE INVENTION

Figure 4:
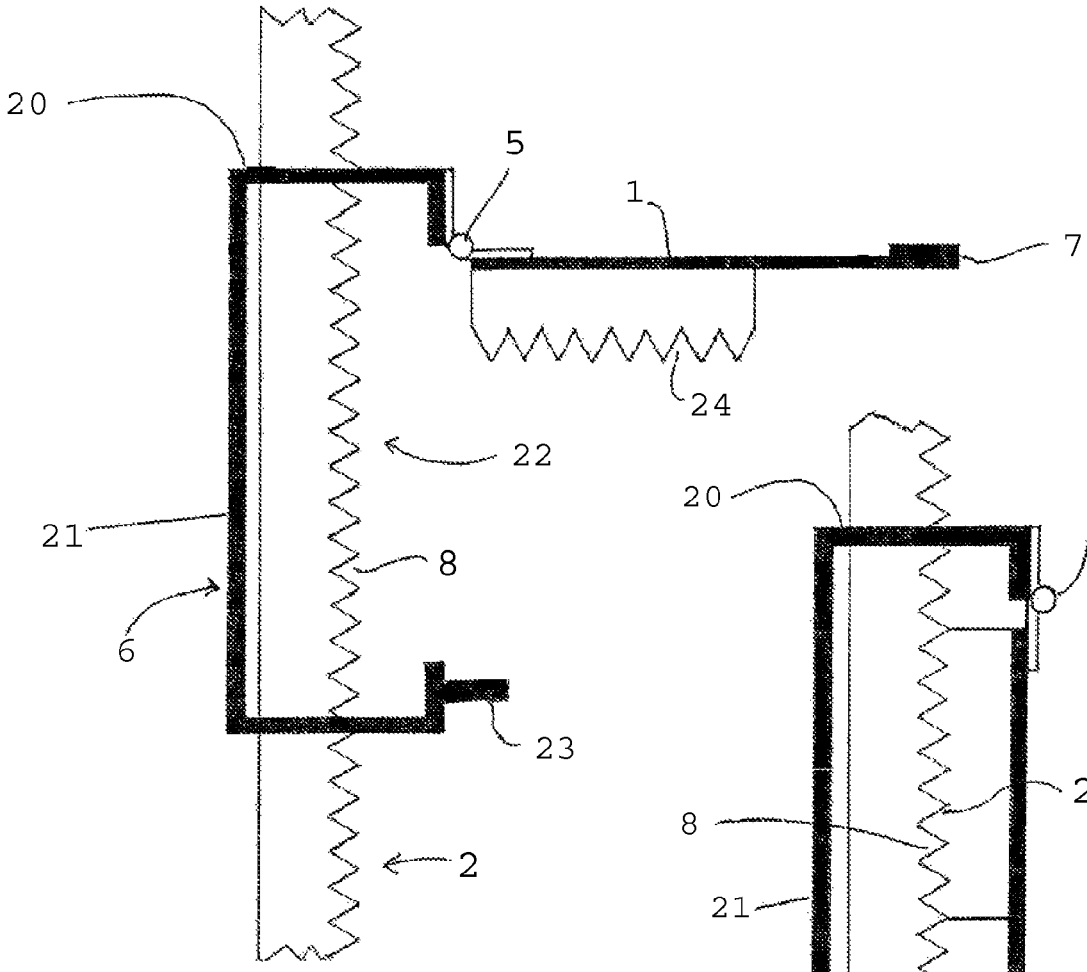
FIG. 4 is an enlarged fragmentary side view of the leveling device embodying the principles of the present invention, shown in an unlocked configuration.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description of the Invention," relates to a requirement of the United States Patent Office, and does not imply, nor should be inferred to limit the subject matter disclosed herein.

Referring now to the figures, and in particular to FIGS. 1 and 2, there is illustrated the leveling device in the preferred embodiment of the present invention. Leveling device 100 preferably comprises a frame 6.

Frame 6 preferably is formed as hollow, generally rectangular, horizontal structure, and preferably is constructed of a strong, but lightweight material, such as wood, carbon graphite, nylon or aluminum. However those skilled in the art will appreciate that frame 6 other materials may be used to form frame 6.

Leveling device 100 is configured to be mounted to an object (not shown) such as a chair, table, ladder, scaffolding, jack, barbeque grill, portable stairs and the like by attaching closed side 21 of frame 6 to such object. Those skilled in the art will recognize that numerous means of attachment, both temporary and permanent, may be used to attach leveling device 100 to an object, including screws, bolts and other means.

The top and bottom surfaces of frame 6 are formed with a plurality of closely spaced collars 20, preferably evenly spaced along the length of the top and bottom surfaces of frame 6. Collars 20 are configured to allow support legs 2 to extend through the interior of frame 6 such that support legs 2 may slidably move through collars 20.

Preferably, collars 20 share the same cross-sectional geometry as support legs 2. That is, if support legs 2 are rectangular, then collars 20 preferably are rectangular; if support legs 2 are circular, then collars 20 are circular. In the preferred embodiment, collars 20 have an area slightly greater than the cross-sectional area of support legs 2, so support legs 2 can freely pass through collars 20 with little or minimal resistance.

In the preferred embodiment, collars 20 are configured to hold support legs 2 in a generally vertical configuration, with support legs 2 aligned parallel to one another. In that manner, support legs 20 may move independently of one another.

Frame 6 of leveling device 100 further includes, in the preferred embodiment, a locking mechanism that comprises a pressure plate 1 mounted to frame 6 using a hinge 5. Preferably, hinge 5 runs across the entire length of frame 6 to provide stability and strength.

Pressure plate 1 is mounted on open side 22 of frame 6 in this embodiment and is hinged at the top of open side 22 of frame 6. However, it will be appreciated that, in some embodiments, pressure plate 1 may be hinged at the bottom of open side 22 of frame 6 without departing from the scope of the present disclosure. By locating hinge 5 at the bottom of open side 22 of frame 6, for example, additional leverage may be obtained such that the pressure plate 1 may be secured in a one-handed manner.

Pressure plate 1 preferably is constructed of a strong, but lightweight material, such as wood, carbon graphite, nylon or aluminum, and is configured to hingedly rotate in a manner that effectively opens and closes open side 22 of frame 6.

In the preferred embodiment, pressure plate 1 is formed with a handle 7 extending outwardly therefrom and configured to engage a latch 23 (or other securing means) to secure pressure plate 1 in a closed position, as further described below. Pressure plate 1 also is formed with a plurality of grooves and/or protuberances 24 along its inside surface.

Protuberances 24 are configured to engagingly mate with similarly configured protuberances formed on support legs 2, as further discussed below, to further strengthen the engagement of pressure plate 1 with support legs 2 when support legs 2 are locked into place. As those skilled in the art will recognize, the geometry of protuberances 24 can vary (square, triangle, etc.), however, in the preferred embodiment, protuberances 24 are triangular.

As discussed above, support legs 2 may be formed in various shapes (with various geometric cross-sections). Preferably, support legs 2 are either cylindrical or rectangular members. In the most preferred embodiment, as shown in FIGS. 1-3, support legs are rectangular members. Those skilled in the art will appreciate, however, that support legs 2 can be formed in any shape as may be desirable depending on the particular use of leveling device 100, and all such shapes are included within the scope of this disclosure.

Preferably, support legs 2 are formed of a strong, but lightweight and durable material, such as wood, carbon graphite, nylon or aluminum. The particular choice of material is determined by the desired load bearing properties of leveling device 100.

For example, in some applications, support legs 2 may be made of steel and may be capable of supporting a relatively large amount of weight (such as when leveling device 100 is used, for example, with a jack stand). In the preferred embodiment, support legs 2 are formed of wood and comprise either circular or rectangular dowels having diameters (or widths) of between ½ and 1 inches. However, those skilled in the art will recognize that numerous other sizes for support legs 2 are possible.

In the preferred embodiment, support legs 2 are formed with caps 3 (or other stopping means) on the top surfaces of support legs 2 to prevent support legs 2 from passing completely through frame 6. In this manner, support legs 2 may slidably pass through frame 6, through collars 20, without fully passing through frame 6 when extended fully downward. When extended fully downward, caps 3 on support legs 2 engage the top surface of frame 6, thereby preventing support legs 2 from moving further.

The bottom surfaces 4 of support legs 2 are configured to engage the ground or other surface on which leveling device 100 will be used. As shown in FIGS. 1-3, in the preferred embodiment, bottom surfaces 4 are flat. However, in other embodiments (not shown), bottom surfaces 4 may be formed with a pointed geometry configured to pierce or otherwise engage the ground to provide additional traction. Such a pointed geometry is particularly useful when leveling device 100 is used on a soft surface, such as grass or moist ground.

Figure 5:
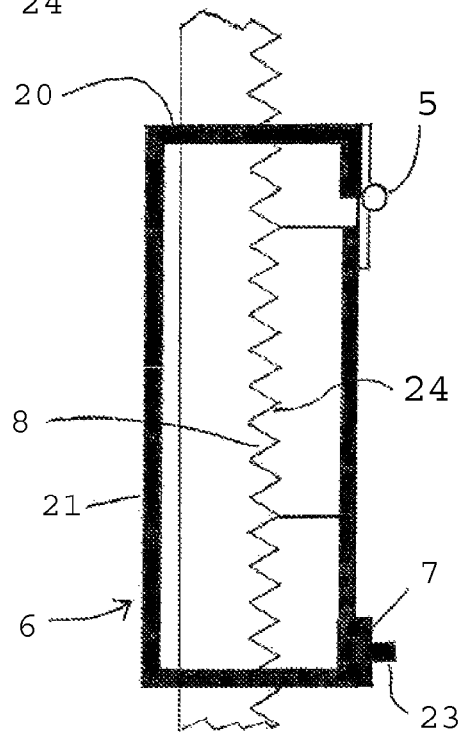
FIG. 5 is an enlarged fragmentary side view of the leveling device embodying the principles of the present invention, shown in a locked configuration.

In the preferred embodiment, support legs 2 are further configured with protuberances 8 along one side of their lengths. Protuberances 8 preferably are the same geometry as protuberances 24 formed on pressure plate 1. When support legs 2 are positioned within frame 6 of leveling device 100, the sides of support legs 2 that contain protuberances 8 face open side 22 of frame 6. In that manner, as shown in FIGS. 4 and 5, when pressure plate 1 engages support legs 2, as further discussed below, protuberances 24 matingly engage protuberances 8 to help secure support legs 2 in place.

Figure 10:
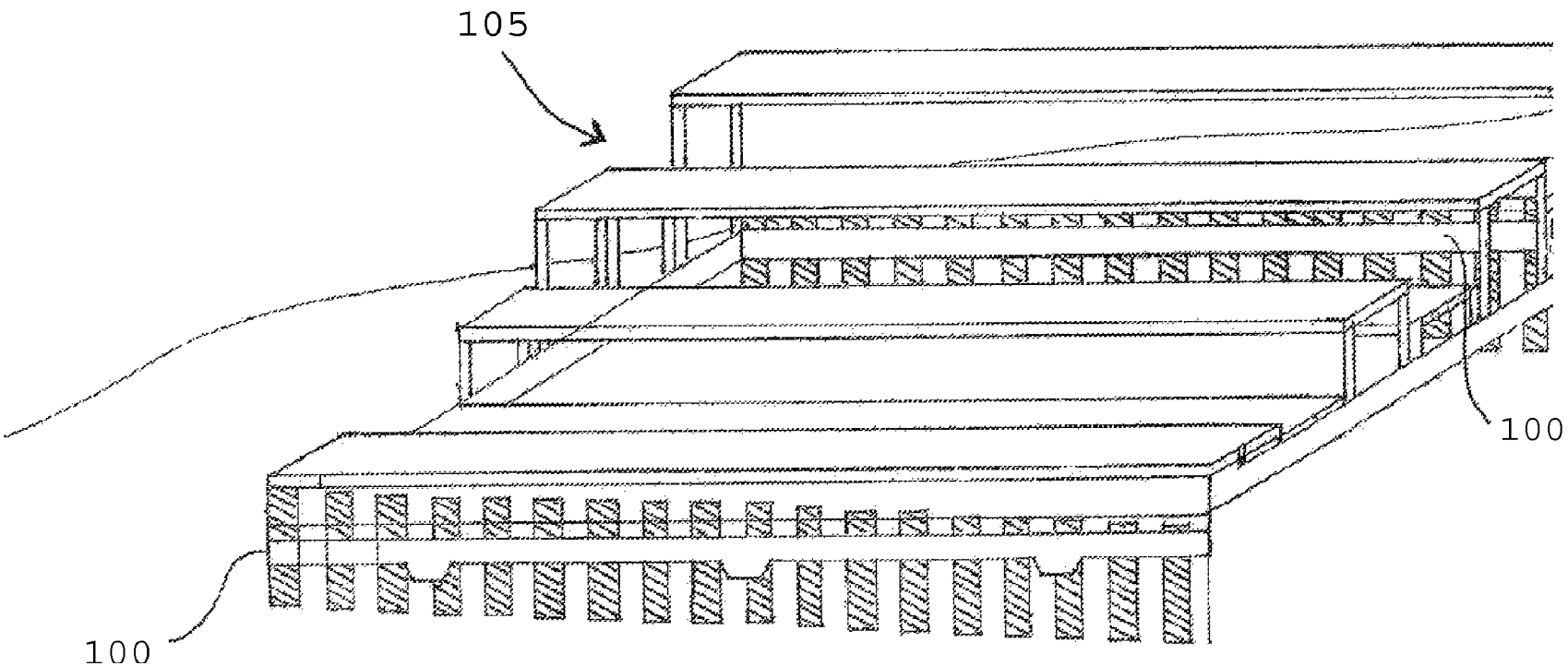
FIG. 10 is a perspective view of the leveling device embodying the principles of the present invention as shown attached to a temporary bleacher structure.
Figures 11A, 11B:
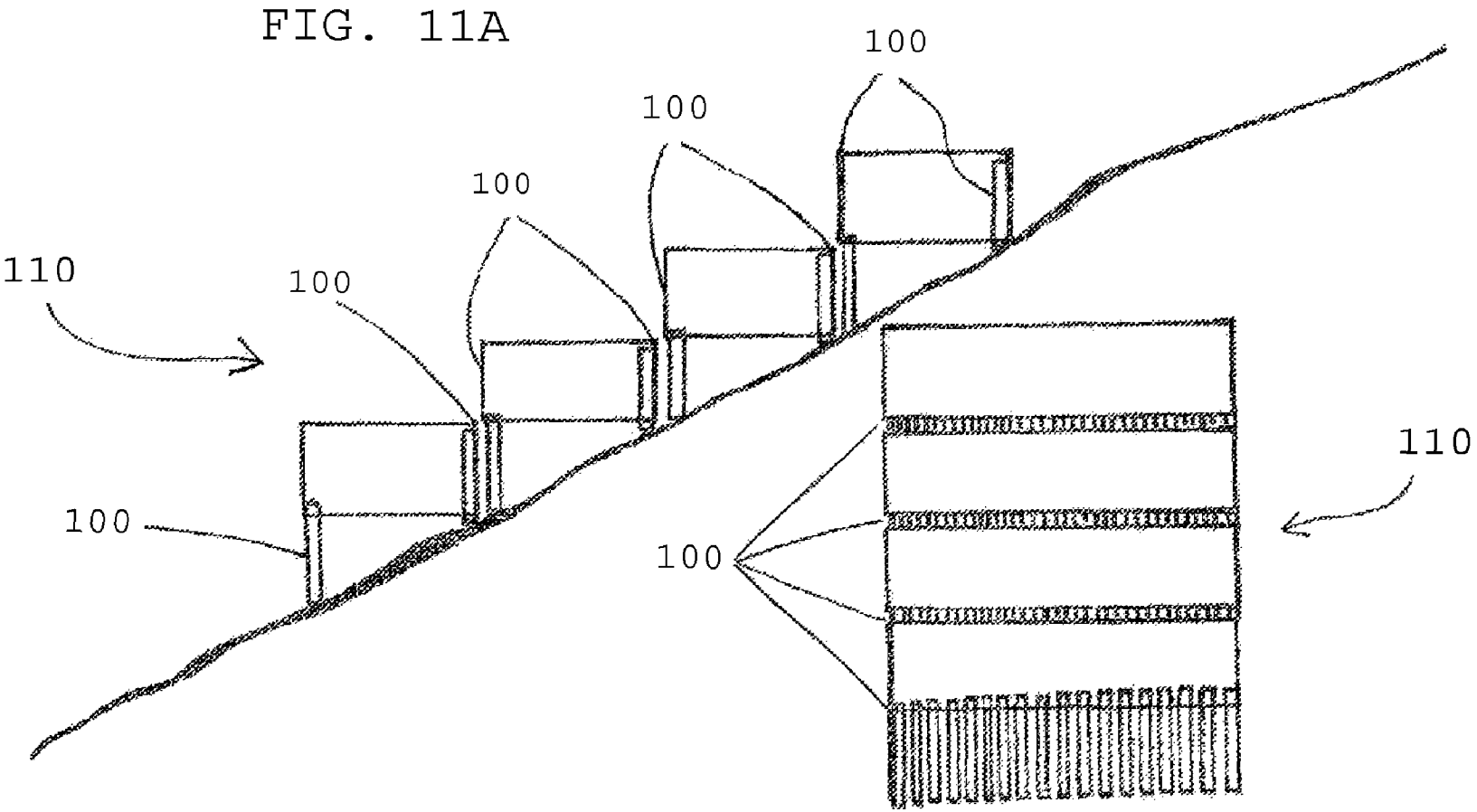
FIG. 11*a* is a side view of the leveling device embodying the principles of the present invention as shown attached to a temporary stair structure; and, FIG. 11*b* is a front view of the leveling device embodying the principles of the present invention as shown attached to a temporary stair structure.

In operation, leveling device 100 is attached to an object, such as a chair 80 (FIG. 8), temporary bleachers 105 (FIG. 10) or temporary stairs 110 (FIGS. 11*a* and 11*b*). It will be appreciated by those skilled in the art that multiple leveling devices 100 may be used for some objects. For example, leveling devices 100 may be attached to both the front support bar and the rear support bar of chair 80 shown in FIG. 8. As discussed above, leveling devices 100 may be attached to chair 80 (or other objects) using attachment means known to those skilled in the art, such as screws, bolts, etc.

To level an object on an uneven surface, the object is placed in the location where it is to be used. Pressure plate 1 then is disengaged from frame 6 by releasing handle 7 from latch 23 and rotating pressure plate 1 away from open side 22 of frame 6. In this manner, protuberances 24 of pressure plate 1 disengage from protuberances 8 of support legs 2, thereby allowing support legs 2 to slide freely through collars 20 of frame 6.

Support legs 2 then are permitted to engage the ground or other surface while the position of the object is adjusted relative to the surface such that the object is level. Because support legs 2 are able to freely slide within collars 20 of frame 6, support legs 2 adapt to the contour of the surface, with each individual support leg 20 extending through frame 6 only as much as necessary for bottom surface 4 of support leg 20 to engage the surface.

Once the object is level and support legs 2 are properly positioned, pressure plate 1 is rotated toward open side 22 of frame 6. In this manner, protuberances 24 of pressure plate 1 matingly engage with protuberances 8 of support legs 2, and support legs 2 are forced into frictional engagement with collars 20 of frame 6. The combined frictional and mechanical engagement of support legs 2 with collars 20 and pressure plate 1 locks support legs 20 in place, preventing further vertical movement of support legs 20.

Pressure plate 1 then may be locked into place by engaging handle 7 with latch 23. Those skilled in the art will appreciate that numerous means to lock pressure plate 1 into place are possible, including latch 23 and various combinations of bolts, nuts and other means. All such means are included within the scope of this disclosure.

When the object need to be repositioned or placed on a different surface, the above process is repeated to reset support legs 2 to match the contour of the new surface.

Figures 8, 9:
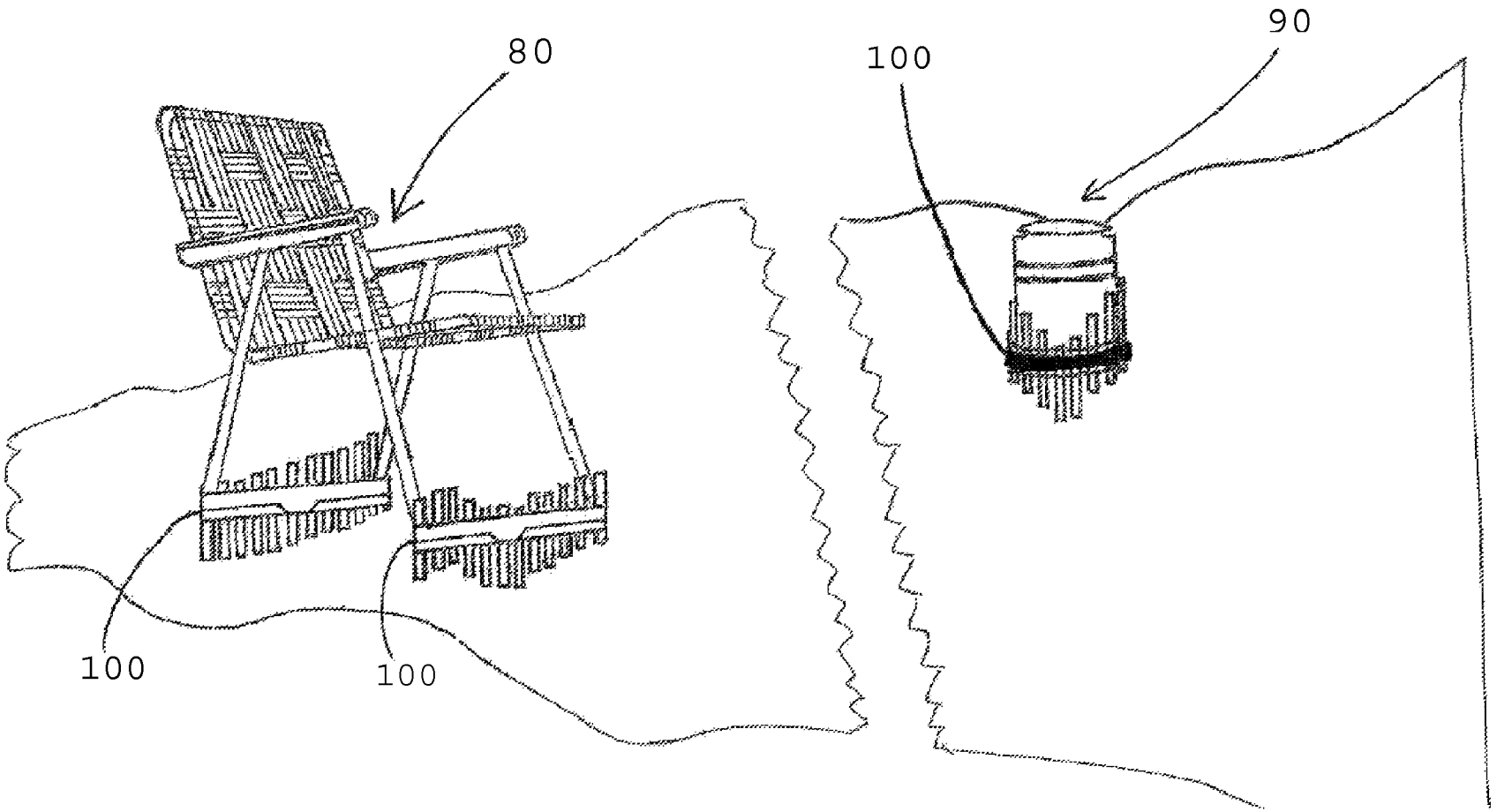
FIG. 8 is a perspective view of the leveling device embodying the principles of the present invention as shown attached to a lawn chair.
FIG. 9 is a perspective view of the leveling device embodying the principles of the present invention as shown attached to a circular hunting/fishing bucket.

As noted above, several embodiments of the locking mechanism of leveling device 100 of the present invention are possible, depending upon the materials being used and object with which leveling device 100 will be used. For example, pressure plate 1 as described in the preferred embodiment could be secured against support legs 2 using a chain binder or ratchet strap mechanism (especially when leveling device 100 is configured in a circular configuration, such as when attached to a circular hunting/fishing bucket 90 as shown in FIG. 9). Similarly, pressure plate 1 could be secured against support legs 2 using a battery powered electromagnet or other means.

In an alternate embodiment of leveling device 100 of the present invention, as shown in FIGS. 6 and 7, the locking mechanism comprises a pressure plate 1 that is connected to frame 6 using a plurality of U-bolts 30 that extend through pressure plate 1 and through frame 6, with the U-shaped end of U-bolts 30 extending outwardly from frame 6 on the opposite side of pressure plate 1. In this embodiment, pressure plate 1 is biased away from frame 6 using spring 32 and the U-shaped end of U-bolts 30 serves as a pulling plate.

An oblong pipe or rod 31 is disposed within U-bolts 30 and extends along the length of frame 6. A handle 33 is attached to rod 31 at one end. When handle 33 is rotated, rod 31 rotates within U-bolts 30 and acts as a cam mechanism, causing U-bolts 30 to pull away from frame 6. In this manner, U-bolts 30 act as a pulling plate to pull pressure plate 1 towards frame 6 and into engagement with support legs 2.

When handle 33 is rotated fully perpendicular to support legs 2, pressure plate 1 is forced to fully engage support legs 2 such that protuberances 24 of pressure plate 1 matingly engage with protuberances 8 of support legs 2, and support legs 2 are forced into frictional engagement with collars 20 of frame 6. The combined frictional and mechanical engagement of support legs 2 with collars 20 and pressure plate 1 locks support legs 20 in place, preventing further vertical movement of support legs 20. If desired, handle 33 can be locked into place using any appropriate means as known in the art.

When handle 33 is rotated fully parallel to support legs 2, pressure plate 1 releases from support legs 2, under the action of springs 32, and support legs 2 are able to slide freely through collars 20 of frame 6.

All patents referred to herein, are incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A leveling device for leveling an object on an uneven surface, the leveling device comprising:

a frame having a top surface, a bottom surface, a closed side, an open side and a length, wherein the top surface and the bottom surface each have a single row of closely spaced collars formed therein along the length of the frame, the collars formed in the top surface being vertically aligned with corresponding collars formed in the bottom surface;

a plurality of support legs extending through the frame, each of the support legs extending through one of the collars formed in the top surface and the corresponding collar formed in the bottom surface, and each of the support legs having a plurality of protuberances formed along a length thereof; and a pressure plate rotatably and hingedly mounted to the frame, the pressure plate configured to close the open side of the frame and to engage the plurality of support legs, wherein the pressure plate is configured with a plurality of mating protuberances, the mating protuberances configured to matingly engage the protuberances of the support legs to lock the support legs into a fixed position, wherein when the pressure plate is rotated to close the open side of the frame, the plurality of mating protuberances of the pressure plate engage the plurality of protuberances of the support legs thereby locking the support legs into the fixed position.

2. The leveling device in accordance with claim 1 wherein the frame is linear.

3. The leveling device in accordance with claim 1 wherein the frame is non-linear.

4. The leveling device in accordance with claim 1 wherein the plurality of support legs have a circular cross-section.

5. The leveling device in accordance with claim 1 wherein the plurality of support legs have a non-circular circular cross-section.

6. The leveling device in accordance with claim 1 wherein the plurality of protuberances of the support legs comprise teeth.

7. The leveling device in accordance with claim 1 wherein the plurality of mating protuberances of the pressure plate comprise teeth.

8. The leveling device in accordance with claim 1 wherein the pressure plate is hingedly mounted to the frame above the open side of the frame.

9. The leveling device in accordance with claim 1 wherein the pressure plate further comprises a handle, the handle configured to matingly engage a latch disposed on the frame.

10. The leveling device in accordance with claim 1 wherein the plurality of support legs further comprise caps configured to prevent the plurality of support legs from fully passing through the collars formed in the top surface of the frame.

11. The leveling device in accordance with claim 1 wherein the plurality of support legs further comprise a flat bottom surface.

12. The leveling device in accordance with claim 1 wherein the pressure plate further engages the plurality of support legs by forcing the plurality of support legs into frictional engagement with the collars formed in the top surface of the frame.

13. The leveling device in accordance with claim 1 wherein the pressure plate further engages the plurality of support legs by forcing the plurality of support legs into frictional engagement with the collars formed in the bottom surface of the frame.

14. The leveling device in accordance with claim 1 wherein the pressure plate further engages the plurality of support legs by forcing the plurality of support legs into simultaneous frictional engagement with the collars formed in the top surface of the frame and the collars formed in the bottom frame.

15. The leveling device in accordance with claim 1 wherein the the plurality of protuberances of the support legs are formed along at least one side of the support legs.

16. The leveling device in accordance with claim 1 wherein the device is configured to adjust a distance between the object and the uneven surface.

17. A leveling device for leveling an object on an uneven surface, the leveling device comprising:

a frame having a top surface, a bottom surface, a closed side, an open side and a length, wherein the top surface and the bottom surface each have a single row of closely spaced collars formed therein along the length of the frame, the collars formed in the top surface being vertically aligned with corresponding collars formed in the bottom surface;

a plurality of support legs extending through the frame, each of the support legs extending through one of the collars formed in the top surface and the corresponding collar formed in the bottom surface, and each of the support legs having a plurality of protuberances formed along a length thereof; and a pressure plate disposed parallel to the closed side of the frame and the open side of the frame, and disposed adjacent to and spaced apart from the open side of the frame, the pressure plate configured to close the open side of the frame by moving toward the open side of the frame and to engage the plurality of support legs, wherein the pressure plate is configured with a plurality of mating protuberances, the mating protuberances configured to matingly engage the protuberances of the support legs to lock the support legs into a fixed position, and wherein movement of the pressure plate is controlled by a cam mechanism.

* * * * *

UNITED STATES PATENT AND TRADEMARK OFFICE

CERTIFICATE OF CORRECTION

PATENT NO. : 7,774,950 B2
APPLICATION NO. : 12/245465
DATED : August 17, 2010
INVENTOR(S) : Matthew W. Lasley It is certified that error appears in the above-identified patent and that said Letters Patent is hereby corrected as shown below:

Sheet 1, Figure 1: Reference number "1" located on the right hand portion of the figure, below reference number "3" and above reference number "5", should be deleted and replaced with reference number "2".

Sheet 1, Figure 2: Reference number "2" located on the right hand portion of the figure, below reference number "8" and above reference number "23", should be deleted and replaced with reference number "22".

Signed and Sealed this

Sixteenth Day of November, 2010

David J. Kappos

David J. Kappos
*Director of the United States Patent and Trademark Office*